US010883468B2

(12) United States Patent
Terada et al.

(10) Patent No.: US 10,883,468 B2
(45) Date of Patent: Jan. 5, 2021

(54) IGNITION SYSTEM

(71) Applicant: DENSO CORPORATION, Kariya (JP)

(72) Inventors: Kanechiyo Terada, Kariya (JP); Takashi Ohno, Kariya (JP); Keiko Miyake, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/804,041

(22) Filed: Feb. 28, 2020

(65) Prior Publication Data

US 2020/0200138 A1 Jun. 25, 2020

Related U.S. Application Data

(63) Continuation of application No. PCT/JP2018/031325, filed on Aug. 24, 2018.

(30) Foreign Application Priority Data

Aug. 31, 2017 (JP) ..... 2017-167113

(51) Int. Cl.

| | |
|---|---|
| ***F02P 3/05*** | (2006.01) |
| ***F02P 3/04*** | (2006.01) |
| ***F02P 15/10*** | (2006.01) |
| ***F02P 17/12*** | (2006.01) |
| ***H01F 38/12*** | (2006.01) |

(52) U.S. Cl.

CPC ..... *F02P 3/051* (2013.01); *F02P 3/0407* (2013.01); *F02P 15/10* (2013.01); *F02P 17/12* (2013.01); *H01F 38/12* (2013.01)

(58) Field of Classification Search

CPC .. F02P 3/0407; F02P 3/00; F02P 15/10; F02P 17/12; F02P 3/053; F02P 3/051; F02P 13/00; H01F 38/12

See application file for complete search history.

(56) References Cited

U.S. PATENT DOCUMENTS 4,138,977 A * 2/1979 Grather ..... F02P 9/00 123/630
9,054,595 B2 * 6/2015 Umetani ..... H02M 1/34
(Continued)

FOREIGN PATENT DOCUMENTS

| | | |
|---|---|---|
| JP | 2015-200284 | 11/2015 |
| JP | 2016-53358 | 4/2016 |
| WO | 2016/157541 | 10/2016 |

*Primary Examiner* — Sizo B Vilakazi

(74) *Attorney, Agent, or Firm* — Nixon & Vanderhye PC

(57) ABSTRACT

An ignition system includes a primary coil, a secondary coil, a first switch, a second switch, a third switch, a fourth switch, and a switch control section. The primary coil includes a first winding, and a second winding which is connected in series with the first winding. The secondary coil is connected to an ignition plug and is magnetically coupled to the primary coil. The first switch connects and disconnects an electrical path between a first terminal and a ground. The second switch connects and disconnects an electrical path between a power supply and a second terminal. The third switch connects and disconnects an electrical path between the power supply and the first terminal. The fourth switch connects and disconnects an electrical path between a contact point and the ground. The switch control section controls opening and closing of each switch to connect and disconnect the associated electrical path.

12 Claims, 8 Drawing Sheets

(56) References Cited

U.S. PATENT DOCUMENTS

| | | | | |
|---|---|---|---|---|
| 10,381,807 | B2 * | 8/2019 | Takemoto | H01T 23/00 |
| 10,718,288 | B2 * | 7/2020 | Moritsugu | F02P 1/083 |
| 2005/0017724 | A1 * | 1/2005 | McQueeney | F02P 17/00<br>324/380 |
| 2013/0104845 | A1 * | 5/2013 | Koenen | F02P 1/083<br>123/406.12 |
| 2015/0330353 | A1 * | 11/2015 | Bengtsson | F02P 9/002<br>123/637 |
| 2016/0160832 | A1 * | 6/2016 | Skinner | F02P 9/002<br>315/219 |
| 2018/0156179 | A1 * | 6/2018 | Koenen | F02P 1/083 |
| 2020/0049120 | A1 | 2/2020 | Ohno | |
| 2020/0200139 | A1 * | 6/2020 | Ohno | F02P 3/04 |

* cited by examiner

IGNITION SYSTEM

CROSS-REFERENCE TO RELATED APPLICATION

This application is the U.S. bypass application of International Application No. PCT/JP2018/031325 filed Aug. 24, 2018 which designated the U.S. and claims priority to Japanese Patent Application No. 2017-167113, filed Aug. 31, 2017, the contents of both of which are incorporated herein by reference.

TECHNICAL FIELD

The present disclosure relates to an ignition system used in an internal combustion engine.

BACKGROUND

In recent years, to improve the fuel efficiency of an internal combustion engine for automobiles, studies have been conducted on techniques regarding lean fuel combustion control (lean-burn engine) or EGR that recirculates combustion gas to the cylinders of the internal combustion engine. Regarding these techniques, to effectively burn the fuel contained in an air-fuel mixture, studies have been conducted on a continuous discharge mode that causes an ignition plug to continuously generate spark discharges for a certain period of time close to the ignition timing.

A continuous discharge ignition system has been disclosed in, for example, JP 2016-53358 A. In the ignition system, main ignition is started at an ignition plug by supplying a current to a primary coil so that the current flows from a first terminal of the primary coil to a second terminal of the primary coil and then interrupting the passage of the current. Subsequently, the primary coil is energized so that a current flows from the second terminal of the primary coil to the first terminal of the primary coil (in reverse direction). Thus, the current is sequentially added and supplied through the secondary coil in the same direction as the current (secondary current) that flows when the main ignition is turned on. This maintains the spark discharge at the ignition plug.

In the ignition system, to generate a secondary voltage that is enough to maintain the spark discharge at the ignition plug in the secondary coil without using a boost circuit, it is necessary to increase the turn ratio between the primary coil and the secondary coil. For example, the turn ratio between the primary coil and the secondary coil needs to be hundreds of times.

However, the discloser of the present application focused on the point that if the turn ratio between the primary coil and the secondary coil is increased, in starting the spark discharge, the secondary current that occurs in the secondary coil is decreased, which deteriorates the ignitability.

The present disclosure is intended to solve the above problems. The main object is to provide an ignition system that maintains a spark discharge in a suitable manner while inhibiting the ignitability from being decreased.

SUMMARY

In an ignition system according to a first aspect, the ignition system, which causes an ignition plug to generate a spark discharge, includes a primary coil, a secondary coil, a first switch, a second switch, a third switch, a fourth switch, and a switch control section. The primary coil includes a first winding, a second winding connected in series with the first winding, a first terminal located on an opposite side of the first winding from a contact point between the first winding and the second winding, and a second terminal located on an opposite side of the second winding from the contact point. The secondary coil is connected to the ignition plug and is magnetically coupled to the primary coil. The first switch is located on a first terminal side with respect to the primary coil and connects and disconnects an electrical path between the first terminal and a ground. The second switch is located on a second terminal side with respect to the primary coil and connects and disconnects an electrical path between a power supply and the second terminal. The third switch is located on a first terminal side with respect to the first winding and connects and disconnects an electrical path between the power supply and the first terminal. The fourth switch is located on a contact point side with respect to the first winding and connects and disconnects an electrical path between the contact point and the ground. The switch control section controls opening and closing of the first switch, the second switch, the third switch, and the fourth switch to connect and disconnect the associated electrical path.

According to the above configuration, after the first switch and the second switch are closed to pass a current from the side of the second terminal of the primary coil (the first winding and the second winding) to the first terminal side, the first switch and the second switch are opened to interrupt the passage of the current to the primary coil, so that a secondary voltage occurs in the secondary coil, and a spark discharge is generated at the ignition plug. After generating the spark discharge, the third switch and the fourth switch are closed to pass a current to the first winding. At this time, the current flows from the first terminal side to the contact point side. This allows a current to flow in the same direction as and be superimposed on the secondary current that flows through the secondary coil, so that the spark discharge is maintained.

In starting the spark discharge, the current is passed through the primary coil (the first winding and the second winding), and in maintaining the spark discharge, the current is passed through the first winding. Thus, even if the turn ratio between the first winding and the secondary coil is increased, the turn ratio between the primary coil and the secondary coil is inhibited from being increased by adjusting the number of turns of the second winding. Thus, while increasing the secondary current that flows through the secondary coil in starting the spark discharge, the secondary voltage that occurs in the secondary coil is increased in maintaining the spark discharge. That is, while inhibiting the ignitability from being decreased, the spark discharge is maintained in a suitable manner.

In a second aspect, the switch control section is configured to close the first switch and the second switch with the third switch and the fourth switch kept opened to pass a current from the second terminal of the primary coil to the first terminal of the primary coil and subsequently open the first switch and the second switch to interrupt the passage of the current to the primary coil, when starting the spark discharge, and close the third switch and the fourth switch to pass a current from the first terminal side to the contact point side when maintaining the spark discharge after starting the spark discharge.

According to the above configuration, the first switch and the second switch are closed to pass a current from the side of the second terminal of the primary coil (the first winding and second winding) to the first terminal side, and the first switch and the second switch are subsequently opened to interrupt the passage of the current from the power supply to the primary coil, so that the secondary voltage occurs in the secondary coil, and the spark discharge is generated at the ignition plug. In starting the spark discharge, since the third switch and the fourth switch are both opened, the current from the second terminal to the first terminal is inhibited from being decreased.

After generating the spark discharge, a current is passed through the first winding by closing the third switch and the fourth switch. At this time, the current flows from the first terminal side to the contact point side. This allows the current to flow in the same direction as and be superimposed on the secondary current that flows through the secondary coil, so that the spark discharge is maintained. In maintaining the spark discharge, since the first switch and the second switch are both opened, the current from the first terminal to the contact point is inhibited from being decreased.

In a third aspect, the switch control section is configured to alternately repeat closing the third switch and the fourth switch to pass a current from the first terminal side to the contact point side and opening the third switch and the fourth switch to stop supplying electricity from the power supply to the first winding when maintaining the spark discharge. The ignition system further includes a recirculating mechanism which recirculates the current to the first winding when the supply of electricity is stopped.

The above configuration includes the recirculating mechanism, which recirculates the current to the first winding when the supply of electricity is stopped in maintaining the spark discharge. Thus, in maintaining the spark discharge, the current that flows through the first winding is prevented from being rapidly decreased, which inhibits the secondary current that flows through the secondary coil from being rapidly decreased.

In a fourth aspect, the recirculating mechanism includes a recirculation diode including an anode connected to the ground and a cathode connected between the first terminal and the first switch.

According to the above configuration, when the supply of electricity is stopped in maintaining the spark discharge, with the fourth switch kept closed, the third switch is opened to recirculate the current to the first winding through the recirculation diode. Thus, the recirculating mechanism is achieved with a simple structure, and the secondary current is inhibited from being rapidly decreased, so that the spark discharge is unlikely to be interrupted.

In a fifth aspect, the recirculating mechanism includes a recirculation diode and a recirculation control switch. The recirculation diode is disposed in parallel with the first winding and includes an anode connected between the fourth switch and the contact point and a cathode connected between the third switch and the first terminal. The recirculation control switch is disposed in parallel with the first winding and is connected in series with the recirculation diode.

According to the above configuration, in maintaining the spark discharge, when the electricity is supplied from the power supply to the first winding, the third switch and the fourth switch are closed, and the recirculation control switch is opened. When the supply of electricity from the power supply to the first winding is stopped, the fourth switch is opened, and the recirculation control switch is closed. Thus, in stopping the supply of electricity, the current is recirculated to the first winding through the recirculation diode and the recirculation control switch, and the secondary current is inhibited from being rapidly decreased, so that the spark discharge is unlikely to be interrupted.

In a sixth aspect, the recirculating mechanism includes a fifth switch and a recirculation diode. The fifth switch is located between the contact point and the fourth switch and is connected in series with the fourth switch. The recirculation diode includes an anode connected between the fourth switch and the fifth switch and a cathode connected between the first terminal and the third switch.

According to the above configuration, when the supply of electricity is stopped in maintaining the spark discharge, the fourth switch is opened with the fifth switch kept closed, so that the current is recirculated to the first winding through the recirculation diode. This inhibits the secondary current from being rapidly decreased, so that the spark discharge is unlikely to be interrupted.

In a seventh aspect, the ignition system further includes a secondary current detection section which detects a secondary current that flows through the secondary coil. When maintaining the spark discharge, the switch control section opens and closes the third switch based on the secondary current detected by the secondary current detection section.

According to the above configuration, the secondary current is detected, and the supply of electricity from the power supply to the first winding and the stopping of the supply are controlled by opening and closing the third switch based on the detected secondary current to maintain the secondary current to an appropriate value.

In an eighth aspect, the ignition system further includes a backflow prevention diode including an anode connected to the power supply. The second switch is connected to a cathode of the backflow prevention diode and is configured to receive the current from the power supply through the backflow prevention diode. The third switch is connected to the cathode of the backflow prevention diode and is configured to receive the current from the power supply through the backflow prevention diode.

In general, the switches include, for example, antiparallel connected body diodes. Thus, if the power supply is connected in reverse, a large current may possibly flow through the circuit via, for example, the body diodes. In this respect, according to the above configuration, the backflow prevention diode protects the circuit even if the power supply is connected in reverse. In particular, even if the impedance of the second winding is small, a large current is prevented from flowing through the circuit.

In a ninth aspect, a turn ratio, which is a value obtained by dividing the number of turns of the secondary coil by the number of turns of the first winding, is configured to be larger than a voltage ratio, which is a value obtained by dividing a discharge maintaining voltage necessary for maintaining the spark discharge by an applied voltage of the power supply.

Thus, in maintaining the spark discharge, the energy is input without a boost circuit.

In a tenth aspect, a wire diameter of the first winding is larger than a wire diameter of the second winding.

Thus, in maintaining the spark discharge, the current that flows through the first winding is increased to increase the secondary current. Increasing the wire size of only the first winding inhibits the entire size of the primary coil from being increased.

In an eleventh aspect, the power supply, which applies a voltage to the primary coil in starting the spark discharge, is a vehicle-mounted power supply and is shared as a power supply for applying a voltage to the first winding in maintaining the spark discharge.

Since no power supply is necessary within the ignition system, the ignition system is reduced in size. Since the use of the vehicle-mounted power supply eliminates the need for a special power supply, the ignition system is reduced in size. Since the shared use of the vehicle-mounted power supply eliminates the need for multiple power supplies, the ignition system is reduced in size.

In a twelfth aspect, the primary coil, the secondary coil, the first switch, the second switch, the third switch, the fourth switch, and the switch control section are accommodated in a casing of an ignition coil.

The accommodation in the casing of the ignition coil improves the ease of mounting on the vehicle and reduces the wiring.

BRIEF DESCRIPTION OF THE DRAWINGS

The above objects and other objects, features and advantages of the present disclosure will be made clearer by the following detailed description, given referring to the appended drawings. In the accompanying drawings.

DETAILED DESCRIPTION OF THE PREFERRED EMBODIMENTS

Figure 1:
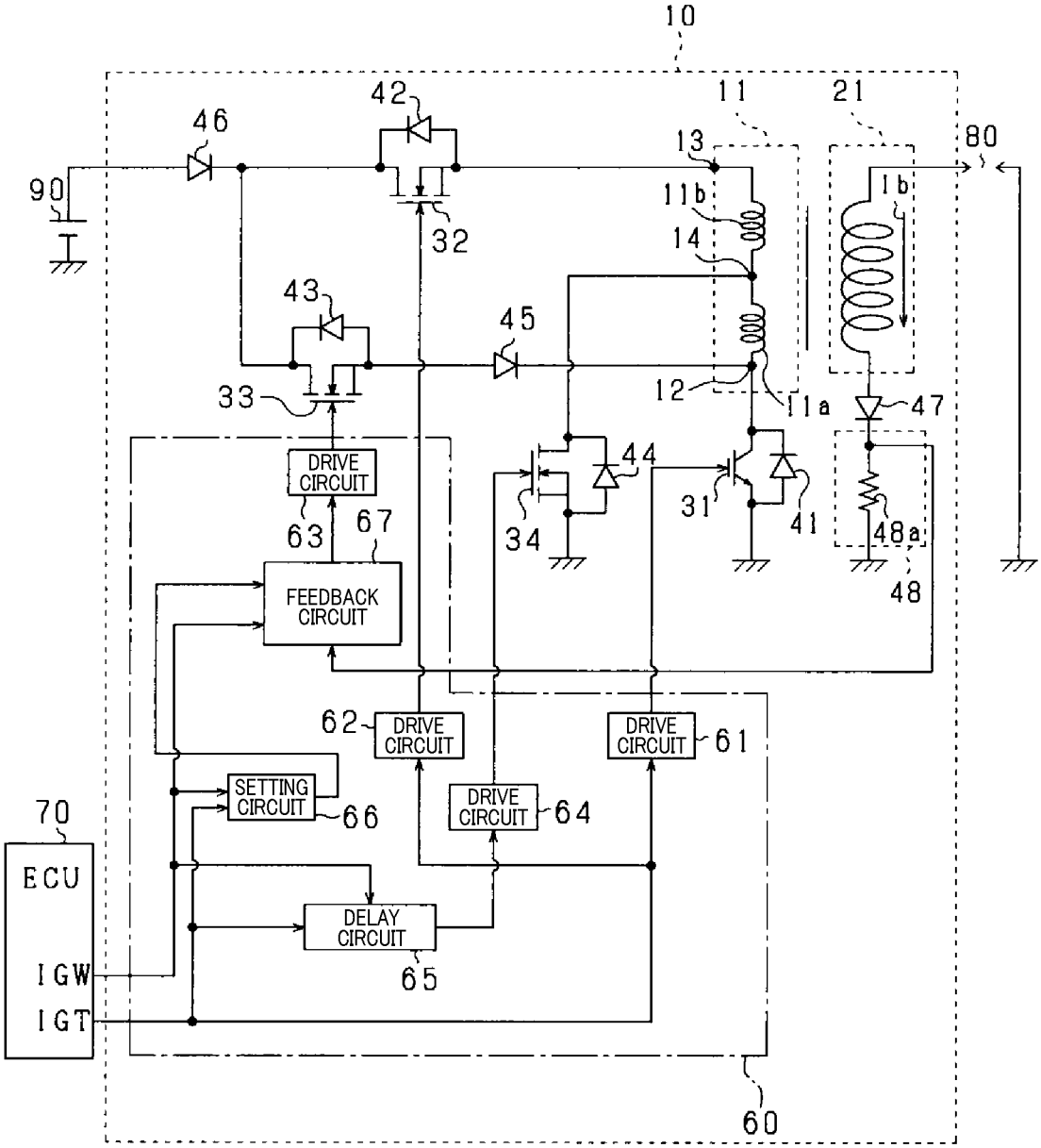
FIG. 1 is a circuit diagram showing an electrical configuration of an ignition system.

Hereinafter, an ignition system according to one embodiment will be described with reference to the drawings. The ignition system is applied to a multi-cylinder gasoline engine (internal combustion engine) mounted on a vehicle. Like or the same components in the following embodiments are given the same reference numerals in the drawings. The engine is, for example, an in-cylinder direct injection engine that is capable of operating in, for example, a lean-burn mode and includes a recirculation control section, which generates recirculation (such as tumble flow and swirl flow) of an air-fuel mixture in the cylinders. The ignition system ignites the air-fuel mixture in a combustion chamber of the engine at a predetermined ignition timing. The ignition system is a direct ignition (DI) system that uses an ignition coil corresponding to an ignition plug of each cylinder.

As shown in FIG. 1, an ignition system 10 controls energization of a primary coil 11 of an ignition coil based on an instruction signal (a main ignition signal IGT and an energy input signal IGW) given from an electronic control unit (ECU) 70 constituting the major part of the engine control. The ignition system 10 controls the energization of the primary coil 11 to control the electrical energy generated in a secondary coil 21 of the ignition coil, thus controlling a spark discharge that occurs at an ignition plug 80.

The ECU 70 selects an ignition mode in accordance with the engine parameters (such as the warm-up state, the engine speed, and the engine load) acquired from various sensors and the control state of an engine 100 (such as whether lean burn operation is performed and the degree of the recirculation) and generates and outputs the main ignition signal IGT and the energy input signal IGW in accordance with the ignition mode.

More specifically, the ECU 70 is configured to select and execute either main ignition (inductive discharge main ignition) or energy input ignition, which is executed to overlap the main ignition, in accordance with the engine speed and the engine load. The main ignition is the mode with the least energy consumption and the least spark energy and is the mode suitable for the operation in, for example, a stoichiometric region. The energy input ignition is the mode that requires the most input energy to continue passing a secondary current Ib of the same polarity to the ignition plug 80 continuously. However, the energy input ignition is the mode suitable for a case in which the airflow speed in the engine is fast due to forced induction and input of EGR, so that the spark is influenced to be extended or blown out by the airflow.

When executing the main ignition, the ECU 70 outputs only the main ignition signal IGT. When executing the energy input ignition, the ECU 70 outputs the energy input signal IGW in addition to outputting the main ignition signal IGT.

The ignition system 10 includes the primary coil 11, the secondary coil 21, switching elements 31 to 34, diodes 41 to 47, a current detection circuit 48, and a control circuit 60.

Figure 2:
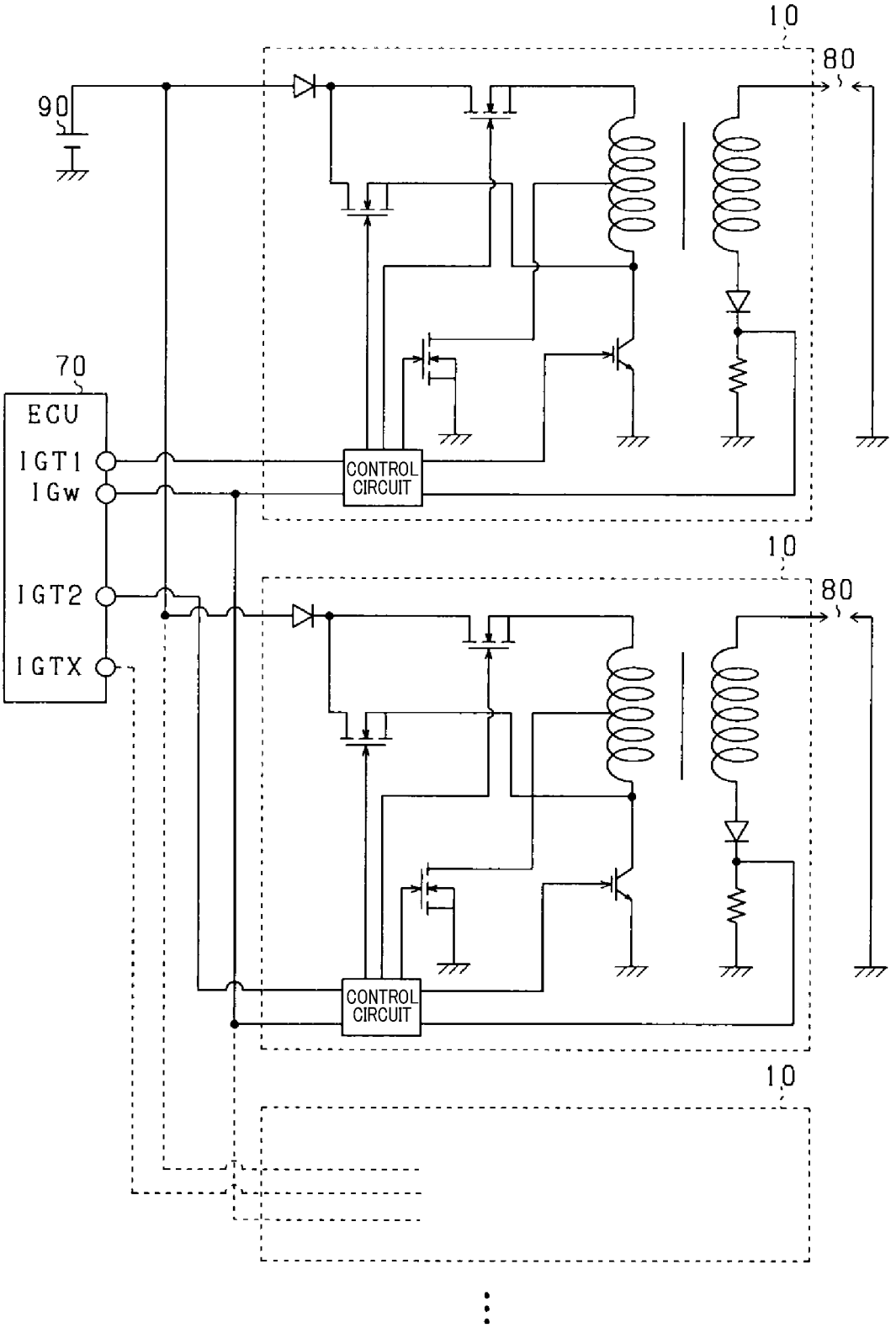
FIG. 2 is a diagram showing the ignition system applied to a multi-cylinder engine.

As shown in FIG. 2, the ignition plug 80 and the ignition system 10 are mounted on each of the cylinders of the engine 100. Although the ignition system 10 is provided for each of ignition plugs 80, the structure corresponding to one ignition plug 80 will be illustrated in this description.

Figure 3:
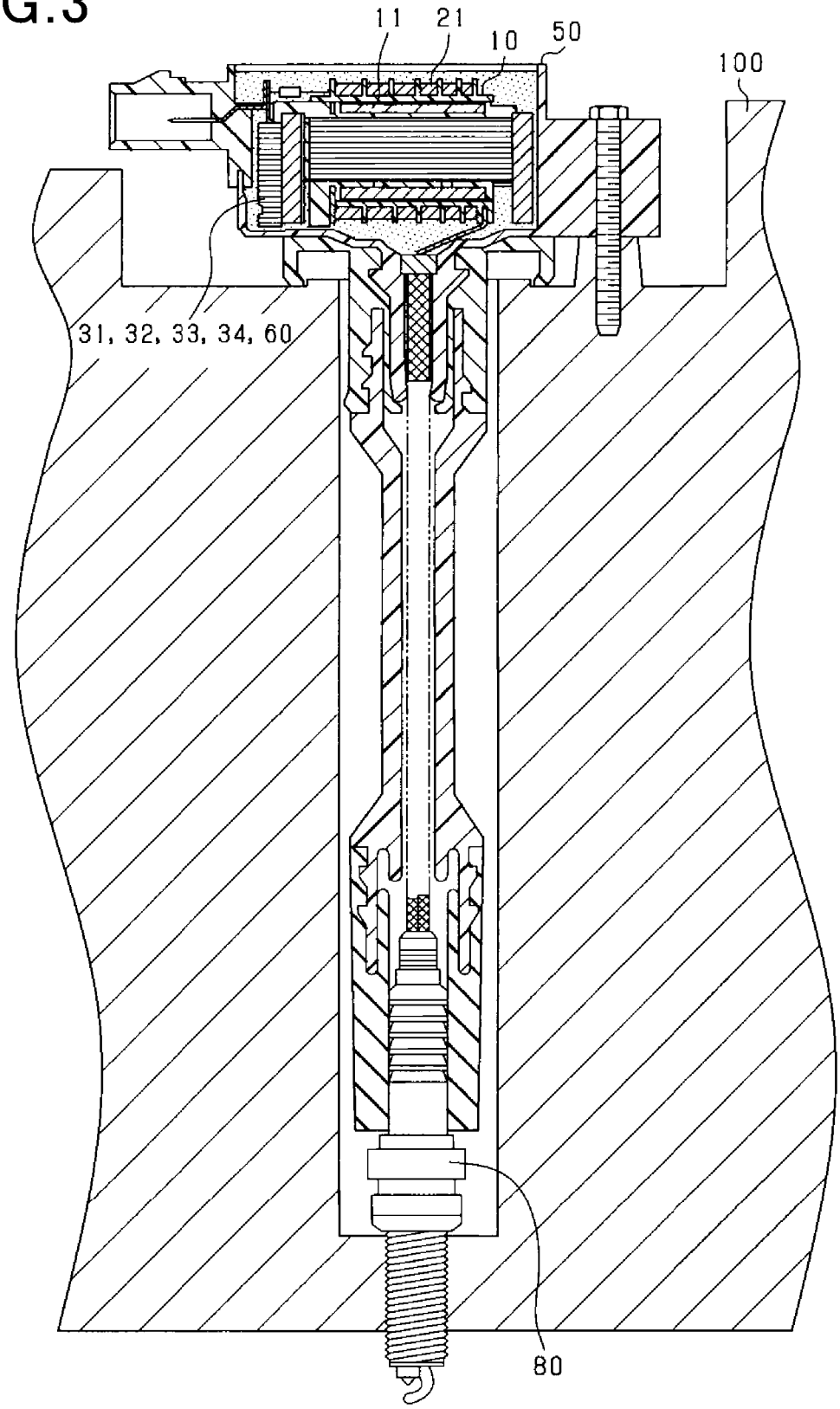
FIG. 3 is a cross-sectional view of a casing of an ignition coil.

The structures of the ignition system 10 are accommodated in a casing 50 of the ignition coil, and the casing 50 is mounted on the engine 100 as shown in FIG. 3. This reduces wiring and inhibits the size of the ignition system 10 from being increased. Thus, the ease of mounting the ignition system 10 on the vehicle is improved.

The ignition plug 80 has a known structure and includes, as shown in FIG. 1, a central electrode, which is connected to one end of the secondary coil 21 through an output terminal, and an outside electrode, which is connected (grounded) to a ground (GND) through, for example, the cylinder head of the engine 100. The other end of the secondary coil 21 is connected (grounded) to the GND through the diode 47 and a current detection resistance 48*a*. The anode of the diode 47 is connected to the secondary coil 21, and the cathode of the diode 46 is connected to the current detection resistance 48*a*.

The current detection resistance 48*a* constitutes the current detection circuit 48. The current detection circuit 48 is a secondary current detection section, which detects the secondary current Ib of the secondary coil 21. The current detection circuit 48 outputs a signal corresponding to the detected secondary current Ib to the control circuit 60. The diode 47 inhibits the spark discharge caused by an unwanted voltage generated when the primary coil 11 is energized. The ignition plug 80 causes the spark discharge between the central electrode and the outside electrode by the electrical energy generated in the secondary coil 21.

The ignition coil includes the primary coil 11 and the secondary coil 21, which is magnetically coupled to the primary coil 11. The number of turns of the secondary coil 21 is larger than the number of turns of the primary coil 11.

The primary coil 11 includes a first terminal 12, a second terminal 13, and a center tap 14. In the primary coil 11, the winding between the first terminal 12 and the center tap 14 is a first winding 11*a*, and the winding between the center tap 14 and the second terminal 13 is a second winding 11*b*. That is, the primary coil 11 includes the first winding 11*a* and the second winding 11*b*, which is connected in series with the first winding 11*a*. The primary coil 11 includes the first terminal 12, which is on the opposite side of the first winding 11*a* from the center tap 14, and the second terminal 13, which is on the opposite side of the second winding 11*b* from the center tap 14. The center tap 14 is a contact point between the first winding 11*a* and the second winding 11*b*.

The first terminal 12 of the primary coil 11 is connected to the switching element 31. The switching element 31 is, for example, a semiconductor switching element such as a power transistor and an insulated-gate bipolar transistor (IGBT). The output terminal of the switching element 31 is connected (grounded) to the GND. That is, the switching element 31 is located between the first terminal 12 and the GND and is connected in series with the first winding 11*a*. The switching element 31 is configured to connect and disconnect between the first terminal 12 and the GND based on the signal from the control circuit 60. Thus, the switching element 31 is located on the first terminal side 12 of the primary coil 11 and corresponds to a first switch that connects and disconnects the electrical path between the first terminal 12 and the GND.

The diode 41 is connected in parallel to the switching element 31. The diode 41 may be a parasitic diode (body diode) of the switching element 31. The anode of the diode 41 is connected (grounded) to the GND, and the cathode of the diode 41 is connected between the first terminal 12 and the switching element 31.

The second terminal 13 of the primary coil 11 is connected to the switching element 32. The switching element 32 is connected in series with the primary coil 11 (the first winding 11*a* and the second winding 11*b*) and the switching element 31. The switching element 32 is, for example, a semiconductor switching element such as a power transistor and a MOS transistor. The switching element 32 is located between the second terminal 13 and a power supply, which is a battery 90, and is configured to connect and disconnect between the second terminal 13 and the battery 90 based on the signal from the control circuit 60. The battery 90 is, for example, a known lead battery and supplies a voltage of 12V. The battery 90 is a vehicle-mounted power supply. Thus, the switching element 32 is located on the side of the second terminal 13 of the primary coil 11 and corresponds to a second switch that connects and disconnects the electrical path between the second terminal 13 and the battery 90.

The switching element 32 is connected in parallel to the diode 42. The diode 42 may be a parasitic diode of a MOS transistor. The anode of the diode 42 is connected between the second terminal 13 and the switching element 32, and the cathode of the diode 42 is connected between the switching element 32 and the battery 90.

The first terminal 12 of the primary coil 11 is connected to the switching element 33. The switching element 33 is connected in series with the first winding 11*a* of the primary coil 11. The switching element 33 is, for example, a semiconductor switching element such as a power transistor and a MOS transistor. The switching element 33 is located between the first terminal 12 and the battery 90 and is configured to connect and disconnect between the first terminal 12 and the battery 90 based on the signal from the control circuit 60. Thus, the switching element 33 corresponds to a third switch located on the first terminal side 12 of the first winding 11*a* and disconnects the electrical path between the battery 90 and the first terminal 12.

The switching element 33 is connected in parallel to the diode 43. The diode 43 may be a parasitic diode of a MOS transistor. The anode of the diode 43 is connected between the first terminal 12 and the switching element 33, and the cathode of the diode 43 is connected between the switching element 33 and the battery 90.

The center tap 14 of the primary coil 11 is connected to the switching element 34. One end of the switching element 34 is connected to the center tap 14 and the other end is connected to the GND. The switching element 34 is, for example, a semiconductor switching element such as a power transistor and a MOS transistor. The switching element 34 is located between the center tap 14 and the GND and is configured to connect and disconnect between the center tap 14 and the GND based on the signal from the control circuit 60. Thus, the switching element 34 corresponds to a fourth switch that is located on the side of the center tap 14 of the first winding 11*a* and connects and disconnects the electrical path between the center tap 14 and the GND.

The switching element 34 is connected in parallel to the diode 44. The diode 44 may be a parasitic diode of a MOS transistor. The anode of the diode 44 is connected between the GND and the switching element 34, and the cathode of the diode 44 is connected to the center tap 14.

When the battery 90 is connected in reverse, a large current may possibly flow through the circuit via the diodes 41 to 44, which are connected in parallel to the switching elements 31 to 34. In the ignition system 10 of the present embodiment, a backflow prevention diode 46 is located between the battery 90 and the switching element 32. The anode of the backflow prevention diode 46 is connected to the battery 90. The cathode of the backflow prevention diode 46 is connected to the switching element 32. That is, the battery 90, the backflow prevention diode 46, the switching element 32, the primary coil 11, and the switching element 31 are connected in series. The cathode of the diode 42 is connected between the switching element 32 and the cathode of the backflow prevention diode 46.

The cathode of the backflow prevention diode 46 is also connected to the switching element 33. That is, the battery 90, the backflow prevention diode 46, the switching element 33, the first winding 11*a*, and the switching element 34 are connected in series. The cathode of the diode 43 is connected between the switching element 33 and the cathode of the backflow prevention diode 46.

As described above, the switching element 32 is connected to the cathode of the backflow prevention diode 46, so that the current from the battery 90 flows via the backflow prevention diode 46. At the same time, the switching element 33 is connected to the cathode of the backflow prevention diode 46, so that the current from the battery 90 flows via the backflow prevention diode 46.

A diode 45 is located between the switching element 33 and the first terminal 12. The anode of the diode 45 is connected to the switching element 33 (and the anode of the diode 43), and the cathode of the diode 45 is connected to the first terminal 12. This prevents a current from flowing to the side of the switching element 33 via the diode 41 or the diode 44. In the present embodiment, the diode 45 is provided, but does not necessarily have to be provided as long as the withstanding pressure is ensured with only the backflow prevention diode 46. Furthermore, during energization for main ignition, to minimize the forward voltage loss of the backflow prevention diode 46, the backflow prevention diode 46 may be removed and the diode 45 may be used to protect from the reverse voltage. In this case, the impedance of the primary coil 11 only needs to be set to limit the current caused by the reverse connection of the battery 90. In particular, the impedance of the second winding 11*b* that has a relatively large number of turns only needs to be set to limit the current that flows from the side of the GND of the switching element 34.

The control circuit 60 (which corresponds to a switch control section) includes, for example, an input/output interface, drive circuits 61 to 64, a delay circuit 65, a setting circuit 66, and a feedback circuit 67. The control circuit 60 controls the open and closed state (connection/disconnection state, ON/OFF state) of the switching elements 31 to 34 based on, for example, the instruction signal from the ECU 70 and the output of the current detection circuit 48. Thus, the control circuit 60 selects and executes one of two ignition modes including "main ignition (inductive discharge main ignition)" and "energy input ignition". Hereinafter, the control circuit 60 will be described in detail.

The drive circuit 61 is configured to receive the main ignition signal IGT from the ECU 70. During the time period in which the main ignition signal IGT is received (during a high state), the drive circuit 61 outputs a signal to the switching element 31 (brings into the high state) so that the switching element 31 is closed (connected state, ON state).

The drive circuit 62 is configured to receive the main ignition signal IGT from the ECU 70. During the time period in which the main ignition signal IGT is received (during the high state), the drive circuit 62 outputs a signal to the switching element 32 (brings into the high state) so that the switching element 32 is closed (connected state, ON state).

The drive circuit 63 is configured to receive a signal from the feedback circuit 67. During the time period in which the signal from the feedback circuit 67 is received (during the high state), the drive circuit 63 outputs a signal to the switching element 33 (brings into the high state) so that the switching element 33 is closed (connected state, ON state).

The drive circuit 64 is configured to receive a signal from the delay circuit 65. During the time period in which the signal from the delay circuit 65 is received (during a high state), the drive circuit 64 outputs a signal to the switching element 34 (brings into the high state) so that the switching element 34 is closed (connected state, ON state).

The delay circuit 65 is configured to receive the main ignition signal IGT and the energy input signal IGW. When the main ignition signal IGT makes a transition from the high state to the low state (when the input is stopped), the delay circuit 65 determines whether the energy input signal IGW is being received (whether the energy input signal IGW is in the high state). If it is determined that the energy input signal IGW is being received, after a predetermined delay time T1 has elapsed from when the main ignition signal IGT made a transition to the low state, the delay circuit 65 outputs a signal to the drive circuit 64 (brings into the high state).

The delay circuit 65 stops outputting the signal to the drive circuit 64 (brings into the low state) based on the energy input signal IGW. More specifically, if the input of the energy input signal IGW is stopped (makes a transition from the high state to the low state), the delay circuit 65 stops outputting the signal to the drive circuit 64 (brings into the low state).

The maximum time T2 of the output time of the signal from the delay circuit 65 to the drive circuit 64 may be set as required. However, to ensure the path of the energy input, it is desirable that the maximum time T2 be longer than the maximum time from the falling of the main ignition signal IGT to the falling of the energy input signal IGW. Moreover, it is desirable that the maximum time T2 end when the secondary current Ib reaches the lower limit value.

The setting circuit 66 sets an upper limit value and a lower limit value of a target secondary current based on the difference between the rising time of the main ignition signal IGT and the rising time of the energy input signal IGW (the time difference when a transition is made from the low state to the high state). The upper limit value and the lower limit value of the target secondary current represent the range of the secondary current Ib that desirably flows through the secondary coil 21 when the energy input ignition is performed.

More specifically, the setting circuit 66 measures the time from when the main ignition signal IGT makes a transition from the low state to the high state to when the energy input signal IGW makes a transition from the low state to the high state and determines the upper limit value and the lower limit value in accordance with the measured time. The upper limit value and the lower limit value are previously stored in accordance with the measured time. Subsequently (for example, after the delay time T1 has elapsed from when the main ignition signal IGT made a transition to the low state), the setting circuit 66 outputs the determined upper and lower limit values to the feedback circuit 67 and sets the upper limit value and the lower limit value in the feedback circuit 67.

When selecting the energy input ignition, the ECU 70 changes the rising time difference between the main ignition signal IGT and the energy input signal IGW in accordance with the operating conditions of the engine 100 to change the lower limit value and the upper limit value in accordance with the operating conditions of the engine 100 and outputs the main ignition signal IGT and the energy input signal IGW. Additionally, the delay time T1 is set to be larger than or equal to the time period from when the main ignition is started to cause flying sparks between the electrodes of the ignition plug 80 to when the secondary current occurs, so that the current input to the first winding 11*a* through the energy input operation does not influence the main ignition operation.

After the target secondary current is set, the feedback circuit 67 outputs a signal to the drive circuit 63 during the time period the energy input signal IGW is received based on the comparison between the target secondary current and the secondary current Ib detected by the current detection circuit 48. More specifically, the feedback circuit 67 switches between a signal output state in which a signal is output to the drive circuit 63 (brings into the high state) and a signal stop state (brings into the low state) so that the absolute value of the secondary current Ib detected by the current detection circuit 48 is maintained between the lower limit value and the upper limit value of the target secondary current during the time period the energy input signal IGW is received (during the high state).

Figure 4:
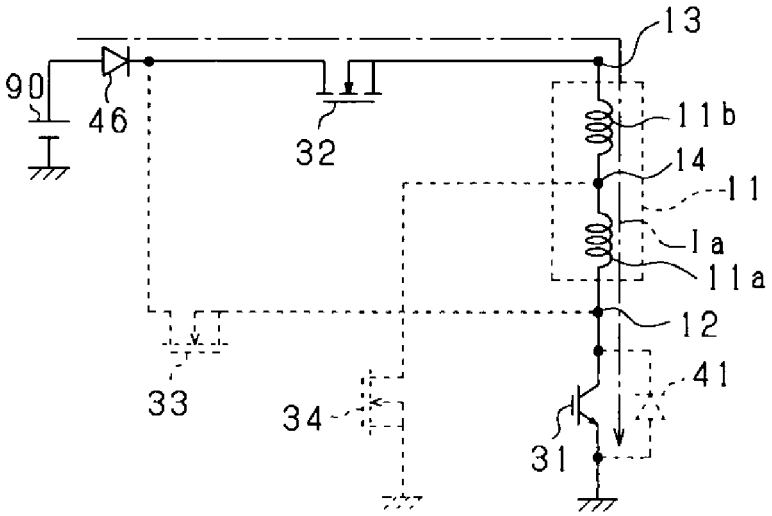
FIG. 4 is a circuit diagram when main ignition is performed.

Subsequently, the manner in which the main ignition is performed will be described based on FIG. 4. In FIG. 4, the energized path is shown by a solid line, and the non-energized path is shown by a broken line. As shown in the drawing, the switching elements 31 and 32 are closed with the switching elements 33 and 34 kept opened. Thus, a current flows from the battery 90 through the path including the backflow prevention diode 46→the switching element 32→the primary coil 11→the switching element 31→and the GND. That is, the primary current Ia flows from the second terminal 13 of the primary coil 11 to the first terminal 12 of the primary coil 11.

The secondary current Ib that seeks to flow through the secondary coil 21 at the starting of the energization of the primary coil 11 is blocked by the diode 47. Since the switching element 33 is open when the main ignition is performed, the current does not flow without passing through the primary coil 11. Additionally, since the switching element 34 is open, the current does not flow to the GND. Thus, the primary current Ia, which flows through the primary coil 11, is inhibited from being decreased.

Subsequently, when the switching elements 31 and 32 are opened, so that the passage of the current to the primary coil 11 is interrupted, a high voltage is generated in the secondary coil 21. Thus, the main ignition is performed at the ignition plug 80, so that the spark discharge is started. At this time, the secondary current Ib flows through the secondary coil 21.

Figure 5:
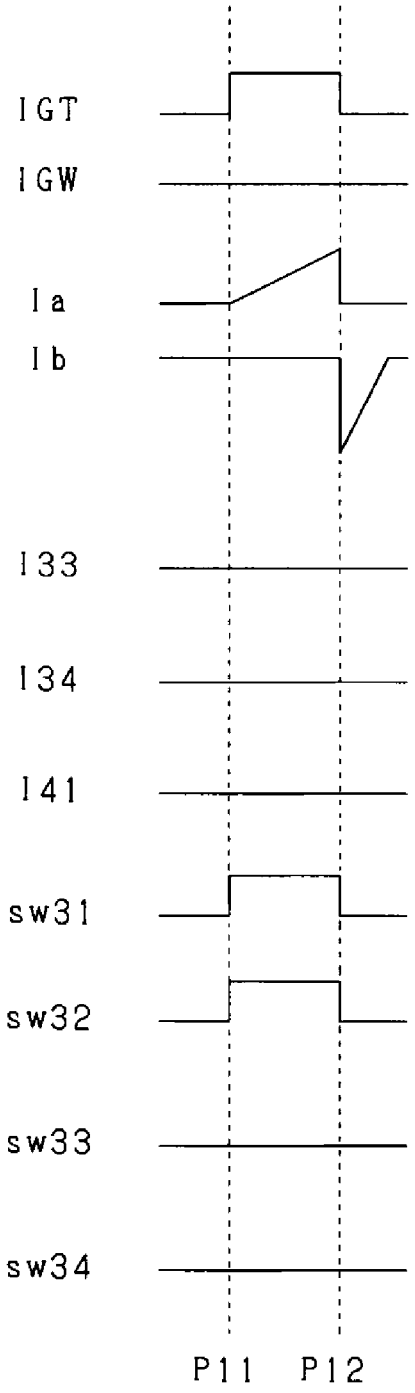
FIG. 5 is a timing chart when the main ignition is performed.

The points in time various signals are input and the manner in which the current changes when the main ignition is performed will be described with reference to FIG. 5. In FIG. 5, the main ignition signal IGT is indicated as IGT, and the energy input signal IGW is indicated as IGW. In FIG. 5, the current that flows through the primary coil 11 (the primary current) is indicated as Ia, and the current that flows through the secondary coil 21 (the secondary current) is indicated as Ib. In FIG. 5, the current that flows through the switching element 33 is indicated as I33, the current that flows through the switching element 34 is indicated as I34, and the current that flows through the diode 41 is indicated as I41.

In FIG. 5, the signal from the control circuit 60 (more specifically, the drive circuit 61) to the switching element 31 is indicated as sw31. In FIG. 5, the signal from the control circuit 60 (more specifically, the drive circuit 62) to the switching element 32 is indicated as sw32. In FIG. 5, the signal from the control circuit 60 (more specifically, the drive circuit 63) to the switching element 33 is indicated as sw33. In FIG. 5, the signal from the control circuit 60 (more specifically, the drive circuit 64) to the switching element 34 is indicated as sw34.

As shown in FIG. 5, the drive circuits 61 and 62 of the control circuit 60 control the switching elements 31 and 32 to be closed (control to be in the ON state, or the connected state. The same applies to the following) for the time period during which the main ignition signal IGT from the ECU 70 is in the high state (points in time P11 to P12). That is, the drive circuits 61 and 62 output signals to the switching elements 31 and 32 respectively from the point in time P11 to the point in time P12 (bring into the high state).

Thus, a voltage (battery voltage) is applied to the primary coil 11 from the battery 90, so that the primary current Ia flows from the second terminal 13 to the first terminal side 12.

When the primary current Ia is increased, and the main ignition signal IGT is brought into the low state at the point in time P12, the drive circuits 61 and 62 control to open the switching elements 31 and 32 respectively (control to be in the OFF state, or the disconnected state. The same applies to the following). That is, the drive circuits 61 and 62 stop outputting signals to the switching elements 31 and 32 respectively (bring into the low state) at the point in time P12.

Thus, a high voltage occurs in the primary coil 11 and the secondary coil 21, which generates a spark discharge at the ignition plug 80 and causes the secondary current Ib to flow through the secondary coil 21. Subsequently, the secondary current Ib attenuates. When the secondary current Ib attenuates and becomes less than a discharge maintaining current, which is the minimum current that can maintain the discharge, the discharge at the ignition plug 80 is terminated.

Figure 6:
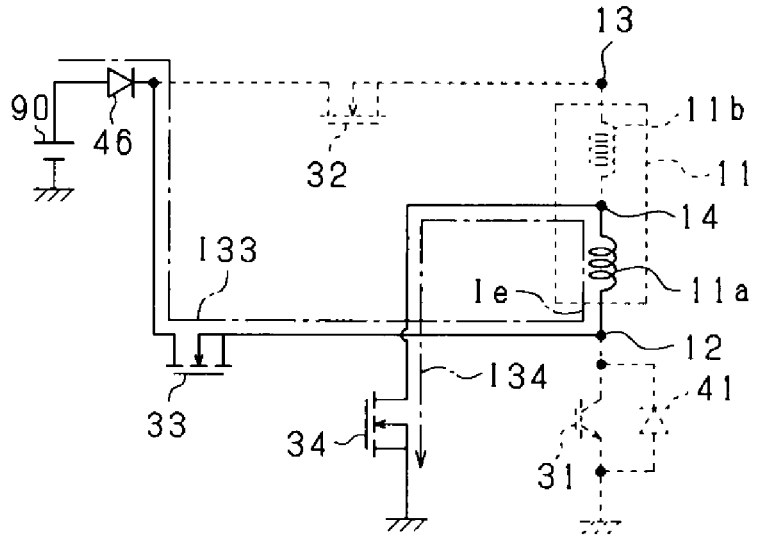
FIGS. 6(*a*) and 6(*b*) are circuit diagrams when energy input ignition is performed.
Figure 6:
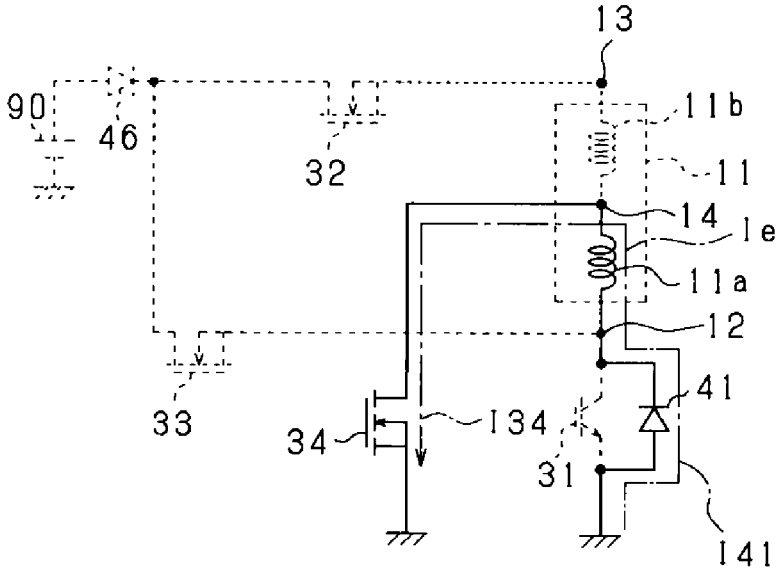

The manner in which the energy input ignition is performed will be described based on FIG. 6. In FIG. 6, the energized path is shown by a solid line, and the non-energized path is shown by a broken line. As shown in FIG. 6(*a*), after starting the main ignition, the switching elements 33 and 34 are closed while the switching elements 31 and 32 are opened. Thus, the current flows from the battery 90 through the path including the backflow prevention diode 46→the switching element 33→the first winding 11*a*→the switching element 34→the GND. That is, a primary current Ie flows from the first terminal 12 of the primary coil 11 to the center tap 14 (energy input). Accordingly, a high voltage occurs in the secondary coil 21 in the same direction as the inductive discharge, and the current is superimposed on the secondary current Ib.

The turn ratio between the first winding 11*a* and the secondary coil 21 is set so that the voltage that occurs in the secondary coil 21 during the energy input becomes higher than the discharge maintaining voltage necessary for maintaining the spark discharge. More specifically, the turn ratio, which is the value obtained by dividing the number of turns of the secondary coil 21 by the number of turns of the first winding 11*a*, is larger than the voltage ratio, which is the value obtained by dividing the discharge maintaining voltage necessary for maintaining the spark discharge by the applied voltage of the battery 90.

In the above-described ignition system 10, to generate the secondary voltage that is enough to maintain the spark discharge in the secondary coil 21 without using a boost circuit in executing the energy input ignition, the turn ratio between the first winding 11*a* and the secondary coil 21 is set large. For example, the turn ratio between the first winding 11*a* and the secondary coil 21 is in the hundreds.

However, when starting the spark discharge, the control circuit 60 passes a current to the primary coil 11 (the first winding 11*a* and the second winding 11*b*), and when maintaining the spark discharge, the control circuit 60 passes a current to the first winding 11*a*. Thus, even if the turn ratio between the first winding 11*a* and the secondary coil 21 is increased, the turn ratio between the primary coil 11 and the secondary coil 21 is inhibited from being increased by adjusting the number of turns of the second winding 11*b*. That is, the turn ratio between the primary coil 11 and the secondary coil 21 is set by adjusting the number of turns of the second winding 11*b*.

Thus, while increasing the secondary current Ib that flows through the secondary coil 21 in starting the spark discharge, the energy input is performed with a low voltage in maintaining the spark discharge, so that the secondary voltage generated in the secondary coil 21 is increased. That is, the spark discharge is maintained in a suitable manner while inhibiting the ignitability from being decreased.

Note that, since the number of turns of the primary coil 11 is the sum of the number of turns of the first winding 11*a* and the number of turns of the second winding 11*b*, an appropriate voltage occurs in the secondary coil 21 and an appropriate secondary current Ib flows when the spark discharge is started.

Referring back to FIG. 6, when the energy is input, the secondary current Ib is gradually increased. The switching element 33 is then opened to stop the energy input and thus the increase in the secondary current Ib so that the secondary current Ib is within the predetermined range.

When the switching element 33 is opened, the battery 90 is disconnected, so that the secondary current Ib is stopped. However, the current that flows through the first winding 11*a* is rapidly decreased, resulting in an undesirable rapid decrease in the secondary current Ib. If the secondary current Ib is rapidly decreased, the secondary current Ib might become less than or equal to the discharge maintaining current, and the discharge might be interrupted in some cases. If the spark discharge is undesirably terminated, even if the energy input is resumed, a voltage generated in the first winding 11*a* is so low that the spark discharge is not achieved, and, thus, the secondary current may possibly fail to be increased.

The ignition system 10 of the present embodiment includes a recirculating mechanism. More specifically, the recirculating mechanism includes the diode 41 as a recirculation diode. Thus, as shown in FIG. 6(*b*), when the switching element 33 is opened, the recirculating current flows through a recirculation path including the GND→the diode 41→the first winding 11*a*→the switching element 34→and the GND. Thus, the primary current Ie is inhibited from being rapidly decreased, which inhibits the secondary current Ib from being rapidly decreased. This facilitates controlling to a predetermined secondary current Ib.

When the secondary current Ib is decreased to a predetermined value, the switching element 33 is controlled to be closed again.

Subsequently, the switching element 33 is opened and closed so that the secondary current Ib is within the predetermined range. Thus, the energy input ignition is performed at the ignition plug 80, so that the spark discharge is maintained.

Figure 7:
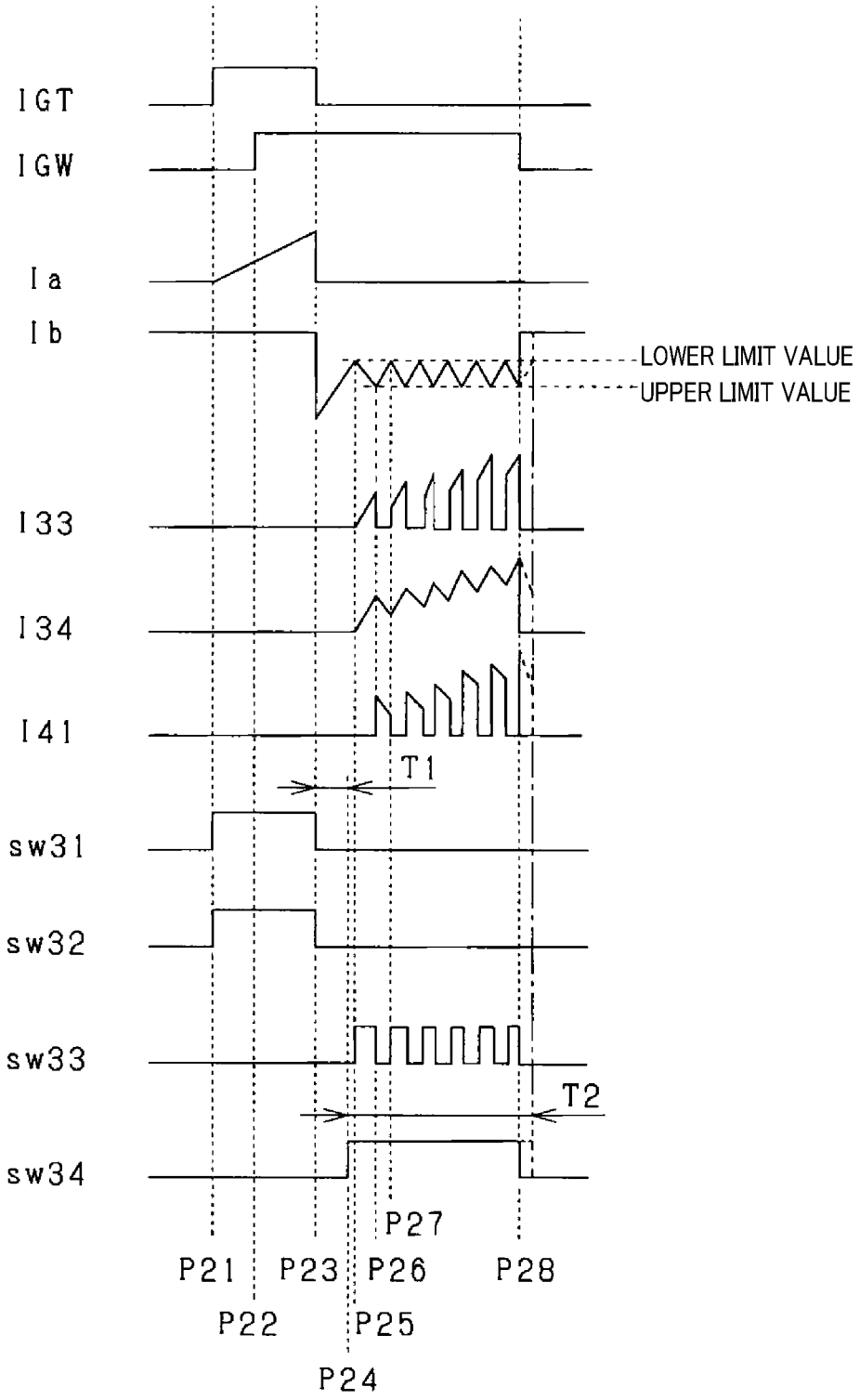
FIG. 7 is a timing chart when the energy input ignition is performed.

The points in time various signals are input and the manner in which the current changes when the energy input ignition is performed after the main ignition will be described based on FIG. 7. IGT, IGW, Ia, Ib, I33, I34, I41, sw31, sw32, sw33, and sw34 in FIG. 7 have the same meaning as those in FIG. 5. As shown in FIG. 7, the energy input ignition is performed by the control circuit 60 if the energy input signal IGW is in the high state when the main ignition signal IGT makes a transition from the high state to the low state.

At a point in time P21, when the main ignition signal IGT is brought into the high state, the drive circuits 61 and 62 control the switching elements 31 and 32 to be closed respectively. That is, the drive circuits 61 and 62 output signals to the switching elements 31 and 32 respectively (bring into the high state). Thus, a voltage (battery voltage) is applied to the primary coil 11 from the battery 90, and the primary current Ia flows from the second terminal 13 to the first terminal 12. Subsequently, the primary current Ia is gradually increased until the switching elements 31 and 32 are opened (the point in time P21 to a point in time P23).

At the point in time P23 when the main ignition signal IGT is brought into the low state, the drive circuits 61 and 62 control the switching elements 31 and 32 to be opened respectively. That is, the drive circuits 61 and 62 stop outputting signals to the switching elements 31 and 32 respectively (bring into the low state). This causes a high voltage in the primary coil 11 and the secondary coil 21, so that a spark discharge is generated at the ignition plug 80, and the secondary current Ib flows through the secondary coil 21. Subsequently, the secondary current Ib of the secondary coil 21 is gradually decreased until the energy is input (the point in time P23 to a point in time P24).

At the point in time P24, the drive circuit 64 receives a signal from the delay circuit 65 and controls to close the switching element 34. That is, at the point in time P24, the drive circuit 64 outputs a signal to the switching element 34 (brings into the high state). The point in time P24 is the point in time when the predetermined delay time T1 has elapsed from the point in time P23 at which the main ignition signal IGT made a transition from the high state to the low state. Thus, the switching element 34 is closed after the delay time T1 has elapsed from the point in time P23 at which the main ignition signal IGT made a transition from the high state to the low state.

At the point in time P24, the setting circuit 66 sets the upper limit value and the lower limit value of the target secondary current in the feedback circuit 67. The upper limit value and the lower limit value of the target secondary current are set in accordance with the time period from the point in time P21 at which the main ignition signal IGT made a transition from the low state to the high state to a point in time P22 at which the energy input signal IGW made a transition from the low state to the high state.

After the target secondary current is set, the drive circuit 63 controls the opening and closing of the switching element 33 based on the signal from the feedback circuit 67 and the secondary current Ib for the time period (the point in time P24 to a point in time P28) during which the energy input signal IGW is in the high state. That is, the drive circuit 63 switches between the signal output state in which a signal is output to the switching element 33 and the signal stop state based on the signal from the feedback circuit 67 so that the secondary current Ib is maintained between the lower limit value and the upper limit value of the target secondary current.

For example, if the absolute value of the secondary current Ib becomes less than or equal to the lower limit value of the target secondary current, as shown in a point in time P25 to a point in time P26, the control circuit 60 outputs signals to the switching elements 33 and 34 (brings into the high state), so that the switching elements 33 and 34 are closed.

This causes the primary current Ie to flow from the first terminal 12 of the primary coil 11 to the center tap 14 (energy input). That is, the current I33 (≈primary current Ie) flows through the switching element 33, and the current I34 (≈primary current Ie) flows through the switching element 34. Accordingly, a high voltage is generated in the secondary coil 21 in the same direction as the inductive discharge, and the current is superimposed on the secondary current Ib, so that the secondary current Ib is increased. The primary current Ie is increased in accordance with the energy input. During that time, the current I41 does not flow through the diode 41.

If, for example, the absolute value of the secondary current Ib becomes larger than or equal to the upper limit value of the target secondary current, as shown in the point in time P26 to a point in time P27, the control circuit 60 stops outputting a signal to the switching element 33 (brings into the low state) with the switching element 34 kept closed, so that the switching element 33 is opened. This stops power supply (energy input) from the battery 90 to the second winding 11*b*.

At this time, the recirculating current flows through the recirculation path including the GND→the diode 41→the first winding 11*a*→the switching element 34→the GND. That is, as shown in FIG. 7, the current I34 flows through the switching element 34, and the current I41 (≈I34) flows also through the diode 41. Meanwhile, the current I33 does not flow through the switching element 33.

In this manner, since the recirculating current flows through the first winding 11*a*, the primary current Ie is inhibited from being rapidly decreased, and thus the secondary current Ib is inhibited from being rapidly decreased and is gradually decreased. This facilitates controlling the secondary current Ib to be within the predetermined range.

As described above, the control circuit 60 controls the switching elements 33 and 34 so that the secondary current Ib is maintained between the lower limit value and the upper limit value of the target secondary current during the time period the energy input signal IGW is in the high state (the point in time P24 to the point in time P28).

Subsequently, when the energy input signal IGW makes a transition from the high state to the low state (the point in time P28), the control circuit 60 stops outputting signals to the switching elements 33 and 34 (brings into the low state), so that the switching elements 33 and 34 are opened. This attenuates the secondary current Ib, and when the secondary current Ib becomes less than the discharge maintaining current, which is the minimum current that can maintain the discharge, the discharge at the ignition plug 80 is terminated.

The time period from the point in time P23 at which the main ignition signal IGT makes a transition from the high state to the low state to the point in time P28 at which the energy input signal IGW makes a transition from the high state to the low state is set by the ECU 70 in accordance with, for example, the operating conditions of the engine 100.

The above-described embodiment achieves the following excellent advantages.

The control circuit 60 closes the switching elements 31 and 32 to pass a current from the side of the second terminal 13 of the primary coil 11 to the first terminal side 12 and subsequently opens the switching elements 31 and 32 to interrupt the passage of the current to the primary coil 11. This causes the secondary voltage in the secondary coil 21, thus generating the spark discharge at the ignition plug 80. Additionally, after generating the spark discharge, the control circuit 60 closes the switching elements 33 and 34 to pass a current to the first winding 11*a*. At this time, the current flows from the first terminal side 12 to the side of the center tap 14. This allows the current to flow in the same direction as and be superimposed on the secondary current Ib that flows through the secondary coil 21, so that the spark discharge is maintained.

When starting the spark discharge, the control circuit 60 passes a current to the primary coil 11 (the first winding 11*a* and the second winding 11*b*), and when maintaining the spark discharge, the control circuit 60 passes a current to the first winding 11*a*. Thus, even if the turn ratio between the first winding 11*a* and the secondary coil 21 is increased, the turn ratio between the primary coil 11 and the secondary coil 21 is inhibited from being increased by adjusting the number of turns of the second winding 11*b*. That is, the turn ratio between the primary coil 11 and the secondary coil 21 is set regardless of the number of turns of the first winding 11*a*.

Thus, while increasing the secondary current Ib that flows through the secondary coil 21 in starting the spark discharge, the secondary voltage that is generated in the secondary coil 21 is increased in maintaining the spark discharge. That is, the spark discharge is maintained in a suitable manner while inhibiting the ignitability from being decreased.

In starting the spark discharge (during the main ignition), the secondary voltage that is generated in the secondary coil 21 is limited to be low by setting the turn ratio between the primary coil 11 and the secondary coil 21 regardless of the number of turns of the first winding 11*a*. Accordingly, the voltage applied to the diode 47 is reduced, which allows the diode 47 to have a low withstand voltage, or the diode 47 to be omitted. Thus, the costs of the ignition system 10 are reduced.

When starting the spark discharge, since the control circuit 60 opens both the switching elements 33 and 34, the loss caused by the switching elements 33 and 34 is minimized. This maximizes the variation range when the primary current la is interrupted, and the performance of the main ignition is enhanced.

After generating the spark discharge, the control circuit 60 closes the switching elements 33 and 34 to pass a current to the first winding 11*a*. At this time, the primary current Ie flows from the first terminal side 12 to the side of the center tap 14. This allows a current to flow in the same direction as and be superimposed on the secondary current Ib that flows through the secondary coil 21, so that the spark discharge is maintained. In maintaining the spark discharge, since both the switching elements 31 and 32 are opened, the primary current Ie of the energy input to the first winding 11*a* is inhibited from being decreased.

The control circuit 60 includes a recirculating mechanism that recirculates the current to the first winding 11*a* when the energy input is stopped in maintaining the spark discharge. More specifically, the diode 41 having the anode connected to the GND and the cathode connected between the first terminal 12 and the switching element 31 is employed to form the recirculating mechanism having a simple structure. Thus, when the energy input is stopped in maintaining the spark discharge, by opening the switching element 33 with the switching element 34 kept closed, the current is recirculated to the first winding 11*a* through the diode 41. Thus, in maintaining the spark discharge, the current that flows through the first winding 11*a* is prevented from being rapidly decreased, which inhibits the secondary current Ib that flows through the secondary coil 21 from being rapidly decreased. Since the primary current Ie that flows through the first winding 11*a* is controlled so that the secondary current Ib is within the predetermined range, it is easy for the control circuit 60 to open and close the switching element 33 at appropriate points in time.

Additionally, since the diode 41, which is the recirculation diode, is antiparallel connected to the switching element 31, if the switching element 31 is provided with a parasitic diode, the parasitic diode may be used.

When maintaining the spark discharge, the control circuit 60 opens and closes the switching element 33 based on the secondary current Ib detected by the current detection circuit 48. Thus, the secondary current Ib is maintained to an appropriate value, and the spark discharge is maintained in an appropriate manner.

In some cases, the switching elements 31 to 34 include antiparallel connected diodes 41 to 44. Thus, if the battery 90 is connected in reverse, a large current may possibly flow through the circuit via, for example, the diodes 41 to 44. For this reason, the backflow prevention diode 46 is provided between the switching elements 32 and 33 and the battery 90. The backflow prevention diode 46 protects the circuit if the battery 90 is connected in reverse. In particular, even if the impedance of the first winding 11*a* is small as in the ignition system 10, a large current is prevented from flowing through the circuit.

The turn ratio, which is the value obtained by dividing the number of turns of the secondary coil 21 by the number of turns of the first winding 11*a*, is larger than the voltage ratio, which is the value obtained by dividing the discharge maintaining voltage necessary for maintaining the spark discharge by the applied voltage of the battery 90. Thus, in maintaining the spark discharge, the energy without being changed is input from, for example, the vehicle-mounted battery without a boost circuit.

The battery 90, which applies a voltage to the primary coil 11 in starting the spark discharge, is the vehicle-mounted power supply and is shared as the power supply for applying a voltage to the first winding 11*a* in maintaining the spark discharge. Thus, since no power supply needs to be provided within the ignition system 10, the ignition system 10 is reduced in size. Since the use of the vehicle-mounted power supply eliminates the need for a special power supply, the ignition system 10 is reduced in size. Additionally, since the shared use of the battery 90 eliminates the need for multiple power supplies, the ignition system 10 is reduced in size.

The primary coil 11, the secondary coil 21, the switching elements 31 to 34, and the control circuit 60 are accommodated in the casing 50 of the ignition coil. Thus, the ease of mounting the ignition system 10 on the vehicle is improved and the wiring is reduced.

The control circuit 60 sets the upper limit value and the lower limit value of the target secondary current based on the rising time difference between the main ignition signal IGT and the energy input signal IGW and controls the opening and closing of the switching element 33 so that the secondary current Ib is within the range. Also, whether the energy input is performed is controlled in accordance with whether the energy input signal IGW is input. Thus, the ECU 70 controls the secondary current Ib and the energy input time in an appropriate manner in accordance with the operating conditions of the engine 100 and the environment. This reduces the power consumption and inhibits the wearing out of the ignition plug 80 while improving the ignitability.

Other Embodiments

The present disclosure is not limited to the above-described embodiment, but may be embodied as follows, for example. In the following, the same reference numerals are given to those components that are the same or equal to each other in the embodiments, and the descriptions for the components with the same reference numerals are incorporated herein by reference.

In the above-described embodiment, the recirculating mechanism may be changed as required.

Figure 8:
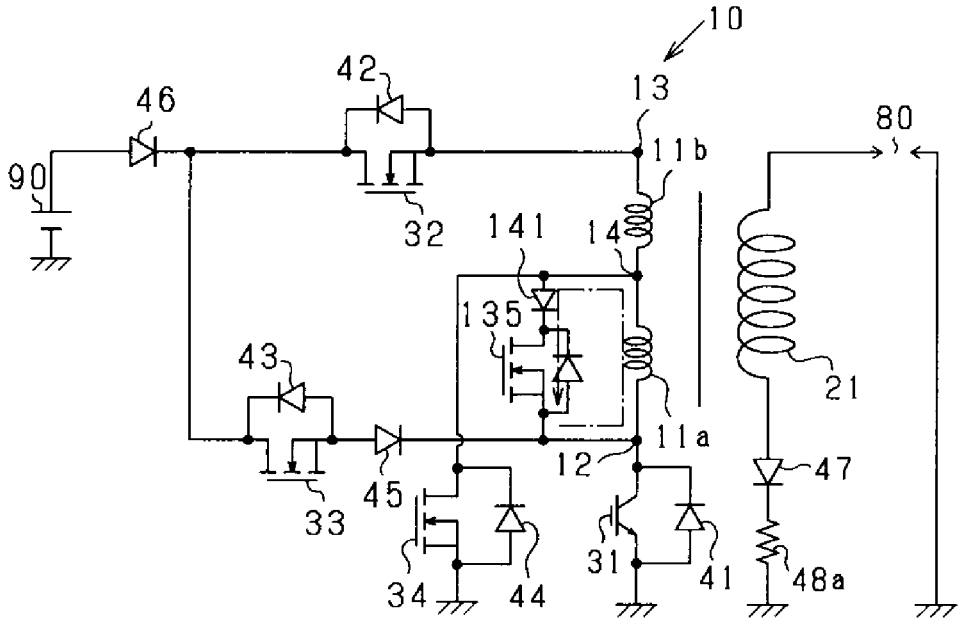
FIG. 8 is a circuit diagram showing an electrical configuration according to a modification of the ignition system.

For example, as shown in FIG. 8, the recirculating mechanism may include a diode 141 disposed in parallel with the first winding 11*a*, and a switching element 135 disposed in parallel with the first winding 11*a* and is connected in series with the diode 141. The switching element 135 is the recirculation control switch. More specifically, the anode of the diode 141 is connected between the switching element 34 and the center tap 14, and the cathode of the diode 141 is connected to one end of the switching element 135. One end of the switching element 135 is connected to the cathode of the diode 141, and the other end of the switching element 135 is connected between the switching element 33 and the first terminal 12.

With this configuration, when maintaining the spark discharge, the control circuit 60 performs the energy input (electricity supply) from the battery 90 to the first winding 11*a* by closing the switching elements 33 and 34 and opening the switching element 135. In contrast, when maintaining the spark discharge, the control circuit 60 stops the energy input from the battery 90 to the first winding 11*a* by opening the switching element 34 and closing the switching element 135. When the energy input is stopped in this manner, the current is recirculated to the first winding 11*a* through the diode 141 and the switching element 135.

Figure 9:
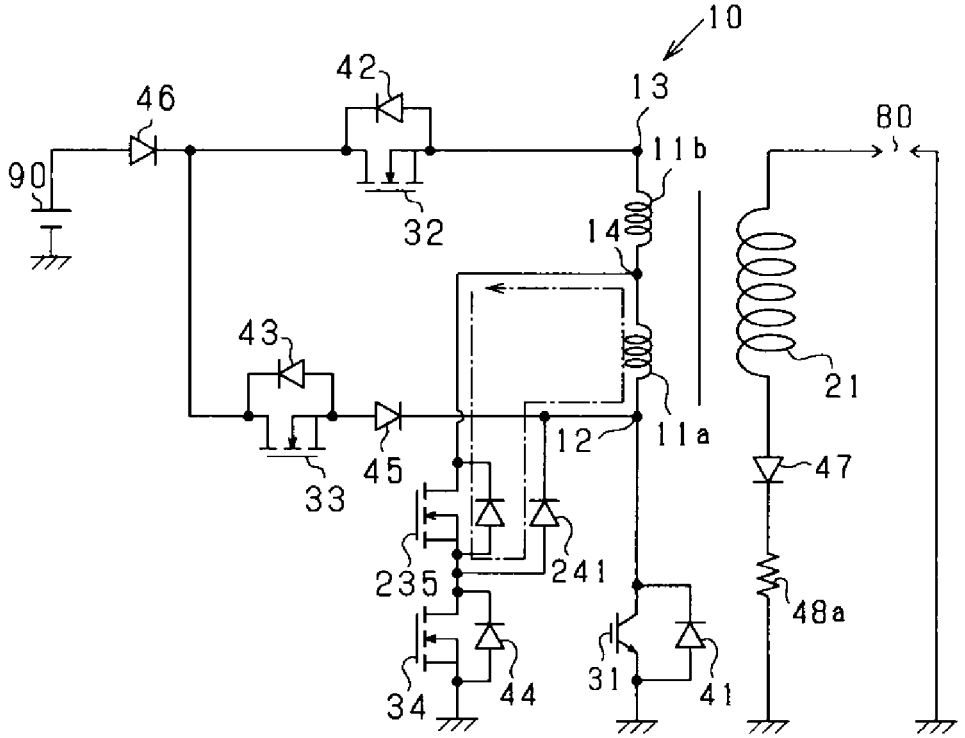
FIG. 9 is a circuit diagram showing an electrical configuration according to a modification of the ignition system.

For example, as shown in FIG. 9, the recirculating mechanism may include a switching element 235, which is a fifth switch located between the center tap 14 and the switching element 34, and a diode 241 located in the path connecting the switching element 235 and the first terminal 12. More specifically, one end of the switching element 235 is connected to the center tap 14, and the other end of the switching element 235 is connected to the switching element 34, so that the switching element 235 is connected in series with the switching element 34. The anode of the diode 241 is connected between the switching element 34 and the switching element 235, and the cathode of the diode 241 is connected between the first terminal 12 and the switching element 33.

With this configuration, when stopping the energy input (electricity supply) in maintaining the spark discharge, the control circuit 60 opens the switching element 34 with the switching element 235 kept closed, so that current is recirculated to the first winding 11*a* through the diode 241. When stopping the energy input (electricity supply) in maintaining the spark discharge, the control circuit 60 may open the switching element 32 as in the above-described embodiment.

In the above-described embodiment, the first winding 11*a* and the second winding 11*b* are formed by providing the center tap 14 on the primary coil 11, but the first winding 11*a* and the second winding 11*b* may be formed by separate windings.

In the above-described embodiment, the upper limit value and the lower limit value of the target secondary current may be certain values and may be previously set in the feedback circuit 67. Thus, the setting circuit 66 may be omitted.

In the above-described embodiment, the upper limit value and the lower limit value of the target secondary current are set based on the rising time difference between the main ignition signal IGT and the energy input signal IGW. However, the setting method may be changed as required. For example, the setting circuit 66 may receive a setting instruction signal from the ECU 70 and may set the upper limit value and the lower limit value of the target secondary current based on the instruction signal.

In the above-described embodiment, the control circuit 60 does not necessarily have to perform a feedback control procedure and may control the opening and closing of the switching element 33 based on predetermined times. For example, when executing the energy input ignition, the control circuit 60 may switch the open and closed states of the switching element 33 at every predetermined switching time. In this case, since the secondary current Ib does not need to be detected, the current detection circuit 48 may be omitted. The feedback circuit 67 may also be omitted. The predetermined switching time may be set by the setting circuit 66, or may be set by the ECU 70.

In the above-described embodiment, the backflow prevention diode 46 may be omitted.

In the above-described embodiment, all or some of the components of the ignition system 10 do not necessarily have to be accommodated in the casing 50 of the ignition coil.

In the above-described embodiment, the battery 90 is shared, but multiple power supplies may be provided. That is, power supplies with different voltages may be used in the main ignition and in the energy input. Thus, for example, the turn ratio between the second winding 11*b* and the secondary coil 21 can be adjusted.

In the above-described embodiment, the vehicle-mounted power supply is used as the battery 90, but a power supply may be provided in the ignition system 10.

In the above-described embodiment, a boost circuit may be provided. When executing the energy input ignition, the control circuit 60 may apply a voltage boosted by the boost circuit to the second winding 11*b*. Thus, for example, the turn ratio between the second winding 11*b* and the secondary coil 21 may be adjusted.

In the above-described embodiment, the wire diameter of the second winding 11*b* may be larger than the wire diameter of the first winding 11*a*. Thus, in maintaining the spark discharge, the current that flows through the second winding 11*b* is increased, so that the secondary current Ib is increased. Increasing the wire diameter of only the second winding 11*b* inhibits the size of the entire primary coil 11 from being increased.

The ignition system 10 of the above-described embodiment is employed in the multi-cylinder engine, but may be employed in a single-cylinder engine. The ignition system 10 may be applied to an internal combustion engine that uses fuel other than gasoline.

In the above-described embodiment, the delay time T1 from when the main ignition signal IGT makes a transition from the high state to the low state to when the delay circuit 65 outputs a signal to the drive circuit 64 may be changed as required.

In the above-described embodiment, the control circuit 60 opens and closes the switching element 31 and the switching element 32 simultaneously in the main ignition operation. However, the same advantages are obtained even if the opening and closing points in time differ from each other.

In the above-described embodiment, the point in time at which the switching element 34 is opened is set to the point in time corresponding to the lower limit value of the secondary current. However, the control accuracy may be increased by reflecting the output from the feedback circuit 67 to the drive circuit 64 and changing to control the switching element 34 when the lower limit value is reached. Alternatively, a long time may be set so that the attenuation of the secondary current Ib by the recirculating current is completed.

Although the present disclosure has been described in accordance with the embodiments, it is understood that the present disclosure is not limited to the embodiments and the configurations. The present disclosure embraces various modifications and deformations that come within the range of equivalency. Additionally, various combinations and forms, or other combinations and forms including only one or more additional elements, or less than all elements are included in the scope and ideas obtainable from the present disclosure.

What is claimed is:

1. An ignition system which causes an ignition plug to generate a spark discharge, the ignition system comprising:

a primary coil including a first winding, a second winding connected in series with the first winding, a first terminal located on an opposite side of the first winding from a contact point between the first winding and the second winding, and a second terminal located on an opposite side of the second winding from the contact point;

a secondary coil connected to the ignition plug and magnetically coupled to the primary coil;

a first switch located on a first terminal side with respect to the primary coil and which connects and disconnects an electrical path between the first terminal and a ground;

a second switch located on a second terminal side with respect to the primary coil and which connects and disconnects an electrical path between a power supply and the second terminal;

a third switch located on a first terminal side with respect to the first winding and which connects and disconnects an electrical path between the power supply and the first terminal;

a fourth switch located on a contact point side with respect to the first winding and which connects and disconnects an electrical path between the contact point and the ground; and a switch control section for controlling opening and closing of the first switch, the second switch, the third switch, and the fourth switch to connect and disconnect the associated electrical path.

2. The ignition system according to claim 1, wherein the switch control section is configured to, close the first switch and the second switch with the third switch and the fourth switch kept opened to pass a current from the second terminal of the primary coil to the first terminal of the primary coil and subsequently open the first switch and the second switch to interrupt the passage of the current to the primary coil when starting the spark discharge, and close the third switch and the fourth switch to pass a current from the first terminal side to the contact point side when maintaining the spark discharge after starting the spark discharge.

3. The ignition system according to claim 1, wherein the switch control section is configured to alternately repeat closing the third switch and the fourth switch to pass a current from the first terminal side to the contact point side and opening the third switch and the fourth switch to stop supplying electricity from the power supply to the first winding when maintaining the spark discharge, and the ignition system further includes a recirculating mechanism, which recirculates the current to the first winding when the supply of electricity is stopped.

4. The ignition system according to claim 3, wherein the recirculating mechanism includes a recirculation diode including an anode connected to the ground and a cathode connected between the first terminal and the first switch.

5. The ignition system according to claim 3, wherein the recirculating mechanism includes:

a recirculation diode disposed in parallel with the first winding and includes an anode connected between the fourth switch and the contact point and a cathode connected between the third switch and the first terminal, and a recirculation control switch disposed in parallel with the first winding and is connected in series with the recirculation diode.

6. The ignition system according to claim 3, wherein the recirculating mechanism includes:

a fifth switch located between the contact point and the fourth switch and which is connected in series with the fourth switch, and a recirculation diode including an anode connected between the fourth switch and the fifth switch and a cathode connected between the first terminal and the third switch.

7. The ignition system according to claim 1, further comprising:

a secondary current detection section which detects a secondary current that flows through the secondary coil, wherein the switch control section opens and closes the third switch based on the secondary current detected by the secondary current detection section when maintaining the spark discharge.

8. The ignition system according to claim 1, further comprising:

a backflow prevention diode including an anode connected to the power supply, wherein the second switch is connected to a cathode of the backflow prevention diode and is configured to receive the current from the power supply through the backflow prevention diode, and the third switch is connected to the cathode of the backflow prevention diode and is configured to receive the current from the power supply through the backflow prevention diode.

9. The ignition system according to claim 1, wherein a turn ratio, which is a value obtained by dividing the number of turns of the secondary coil by the number of turns of the first winding, is configured to be larger than a voltage ratio, which is a value obtained by dividing a discharge maintaining voltage necessary for maintaining the spark discharge by an applied voltage of the power supply.

10. The ignition system according to claim 1, wherein a wire diameter of the first winding is larger than a wire diameter of the second winding.

11. The ignition system according to claim 1, wherein the power supply, which applies a voltage to the primary coil in starting the spark discharge, is a vehicle-mounted power supply and is shared as a power supply for applying a voltage to the first winding in maintaining the spark discharge.

12. The ignition system according to claim 1, wherein the primary coil, the secondary coil, the first switch, the second switch, the third switch, the fourth switch, and the switch control section are accommodated in a casing of an ignition coil.

* * * * *